United States Patent [19]

Sato et al.

[11] Patent Number: 4,903,654

[45] Date of Patent: Feb. 27, 1990

[54] LUBRICATING APPARATUS FOR ENGINES OF VERTICAL CRANKSHAFT TYPE

[75] Inventors: Masato Sato, Akaski; Shinichi Tamba; Toru Ogino, both of Kobe, all of Japan

[73] Assignee: Kawasaki Jukogyo Kabushiki Kaisha, Japan

[21] Appl. No.: 326,566

[22] Filed: Mar. 20, 1989

[30] Foreign Application Priority Data

Mar. 23, 1988 [JP] Japan ..... 63-70516

[51] Int. Cl.[4] ..... F01M 1/00

[52] U.S. Cl. ..... 123/196 W; 184/6.18

[58] Field of Search ..... 123/196 R, 196 W, 196 CP; 184/6.18

[56] References Cited

U.S. PATENT DOCUMENTS

Re. 32,620 3/1988 Iwai ..... 123/196 W
4,727,834 3/1988 Isaka et al. ..... 184/6.18
4,766,859 8/1988 Miyaki et al. ..... 123/196 W
4,805,565 2/1989 Sato et al. ..... 123/90.6

FOREIGN PATENT DOCUMENTS 147906 6/1983 Japan .

*Primary Examiner*—E. Rollins Cross
*Attorney, Agent, or Firm*—Leydig, Voit & Mayer

[57] ABSTRACT

A lubricating apparatus for an engine of vertical crankshaft type according to the present invention includes an oil pan arranged at a lower portion of a crank case for supporting a vertical crankshaft, and an oil tank having a volume larger than that of the oil pan arranged independently from the oil pan, and wherein an outlet of the oil tank is communicated with each of lubricating portions through the oil pan, an intake portion of the oil tank is communicated with the oil pan and the oil in the oil pan is fed into the oil tank by means of an appropriate oil feeding mechanism.

12 Claims, 9 Drawing Sheets

LUBRICATING APPARATUS FOR ENGINES OF VERTICAL CRANKSHAFT TYPE

BACKGROUND OF THE INVENTION

The present invention relates to a lubricating apparatus for an engine of vertical crankshaft type.

In an engine of vertical crankshaft type as disclosed in Japanese Patent Laid-open No. 63-147906 which corresponds to U.S. Ser. No. 108,078 filed on Oct. 14, 1987, an output portion of a vertically supported crankshaft protrudes below an attachment face for the engine, a flywheel is arranged above a crank case, and a cam shaft, governor and driving gear elements including oil pump or an oil slinger are arranged between bearing portions for supporting the crankshaft below a crank web. Accordingly, an oil pan for lubricating the engine is arranged in a space defined by the attachment face for the engine and a bottom of a cam shaft gear and the like.

However, the conventional engine of vertical crankshaft type as mentioned above has the following drawbacks:

(1) Since an area of the oil pan is increased by the presence of a balancer and by a dimension of the gear train, the change in volume of the oil in the oil pan varies in a wider range in accordance with the change in an oil level, thus making the control of the oil level difficult;

(2) Since the area of the oil pan is large, a large amount of oil is not available when the engine is inclined;

(3) Since an oil path to cylinders cannot be inclined largely, a so-called pouring ability is relatively low;

(4) Since a peripheral heat radiating area is considerably limited by the use of the oil pan alone, there is in danger of increasing the temperature of the oil;

(5) Since a number of elements or parts are operated or moved in the oil when the engine is inclined, the temperature of the oil is easily increased; and (6) An amount of the consumed oil will be unstable due to the increase in temperature of the oil.

SUMMARY OF THE INVENTION

An object of the present invention is to provide a lubricating apparatus for an engine of vertical crankshaft type, wherein an oil level can easily be controlled, the oil can adequately be supplied to required portions even when the engine is inclined, and a height of the engine can be reduced.

In order to achieve the above object, the present invention provides a lubricating apparatus for an engine of vertical crankshaft type, wherein an oil pan is provided in a lower portion of a crank case supporting a vertical crankshaft, an oil tank having a volume larger than that of the conventional oil pan is provided independently of the oil pan, an outlet portion of the oil tank is communicated with each of lubricating portions through an oil pump, an intake portion of the oil tank is communicated with the oil pan, and the oil in the oil pan is delivered to the oil tank by means of an appropriate oil feeding mechanism,

DESCRIPTION OF THE PREFERRED EMBODIMENTS

Figure 1:
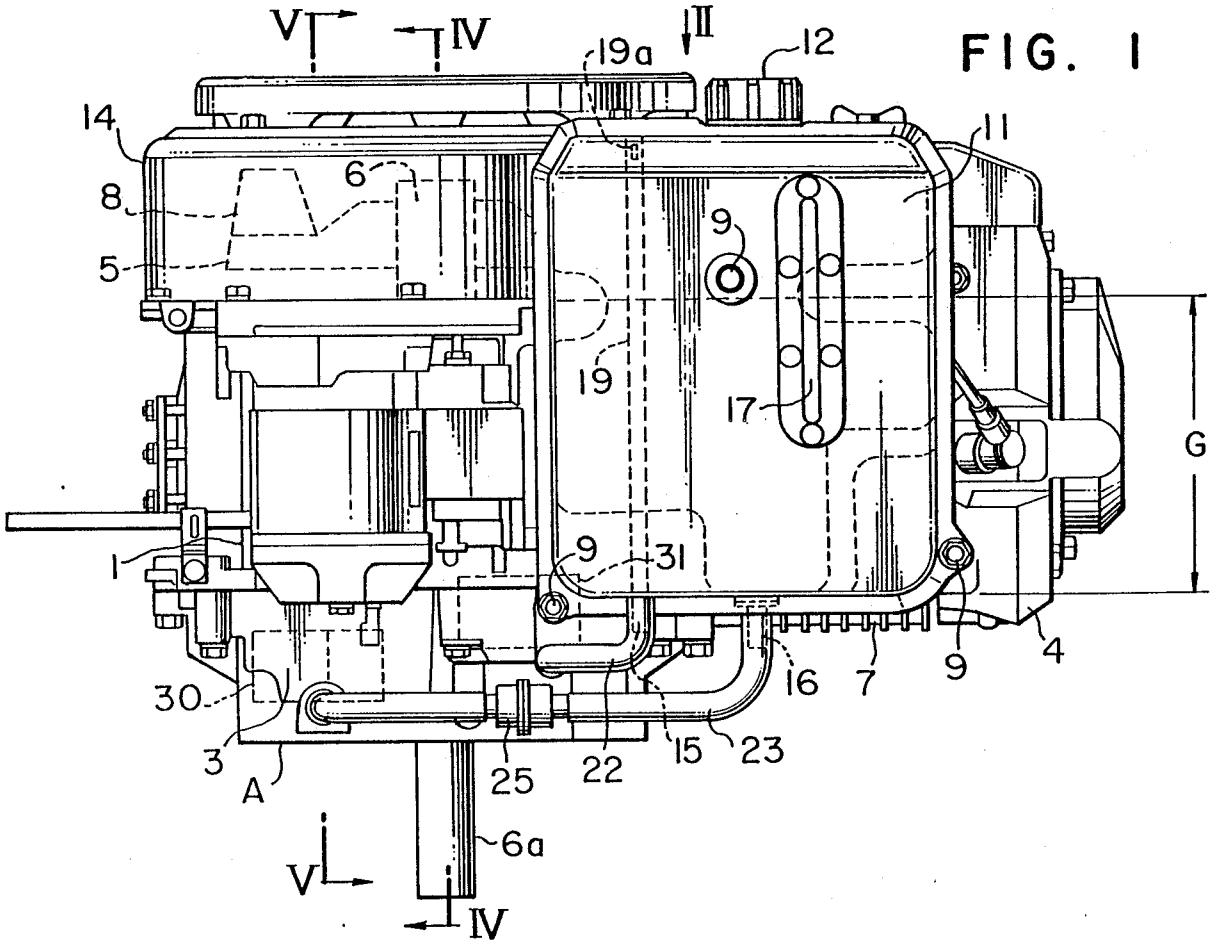
FIG. 1 is a side view of an engine of vertical crankshaft type incorporating a lubricating apparatus according to the present invention.

In a mower incorporating a lubricating apparatus for an engine of vertical type according to the present invention therein as shown in FIG. 1, an oil pan 3 acting also as a cover crank case is fixed to a lower end of a crank case 1, and a vertical crankshaft 6 is supported by the oil pan 3 and crank case 1. A lower output shaft portion **6*a* of the crankshaft 6 protrudes downwardly from a lower attachment face A of the engine and is drivingly connected to a rotary shaft of the mower. On an upper end of the crankshaft 6, there is provided a flywheel 5 and a cooling fan 8 which are covered by a fan cover 14**.

A lubricating oil tank 11 is arranged aside a cylinder portion 7 independently of the oil pan 3 and is fixed to side walls of the cylinder portion 7, a cylinder head 4 and crank case 1 by means of bolts 9. The oil tank 11 has a volume larger than that of the conventional oil pan by twice or more and has a configuration which is vertically elongated and is flat as seen from top. A bottom of the oil tank 11 is substantially positioned at a level of the uppermost portion of the oil pan 3 and a top of the oil tank 11 is substantially positioned at a level of uppermost end of the fan cover 14. In the embodiment shown in FIG. 1, the engine is of an air colled type and the oil tank 11 is made of sheet metal, and a portion (of the oil tank) positioned below the fan cover (i.e., a portion corresponding to a range G) acts also as a cooling air guide plate covering the side of the cylinder portion. A transparent level gauge 17 is provided in the side wall of the oil tank 11 to check the oil level in the tank from outside.

Figure 3:
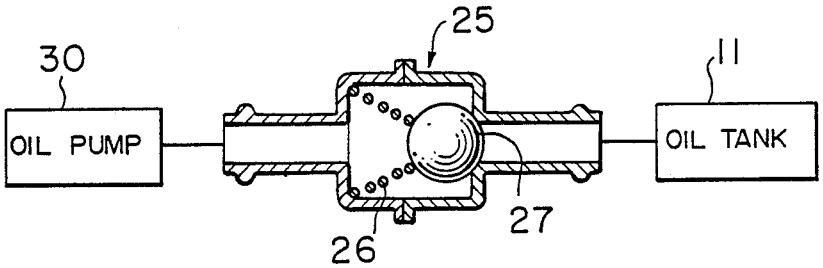
FIG. 3 is an enlarged sectional view of a drain backflow preventing valve used with the engine of FIGS. 1 and 2.

An oil cap 12 having a breather mechanism is removably attached to the top of the oil tank 11, and an oil intake portion 15 and an oil outlet portion 16 are formed on the bottom of the oil tank 11. The oil intake portion 15 includes an oil feeding pipe 19 extending up to the upper end of the oil tank 11 therein, which oil feeding pipe is provided at its upper end with an oil discharging opening 19a. The oil intake portion 15 is connected to a low pressure oil feeding pump 31 through an intake rubber hose 22, whereas the oil outlet portion 16 is connected to a high pressure oil pump 30 through an exhaust rubber hose 23. A drain back-flow preventing pipe 25 as drain back-flow preventing means is arranged in the exhaust rubber hose 23 on the way. As shown in FIG. 3, the pipe 25 includes a spring 25 and a ball valve 27 so as to prevent the back-flow from the oil pump 30 to the oil tank 11 and to permit the oil flow from the oil tank 11 and to permit the oil flow from the oil tank 11 to the oil pump 30 only when the oil pump 30 is being operated. Accordingly, when the engine is stopped, the drain back-flow preventing means 25 is closed to prevent the oil flow both from the oil tank to the oil pump and vice versa, thereby preventing the oil from flowing into the oil pan from the oil tank due to leakage of oil in the oil pump.

Figure 2:
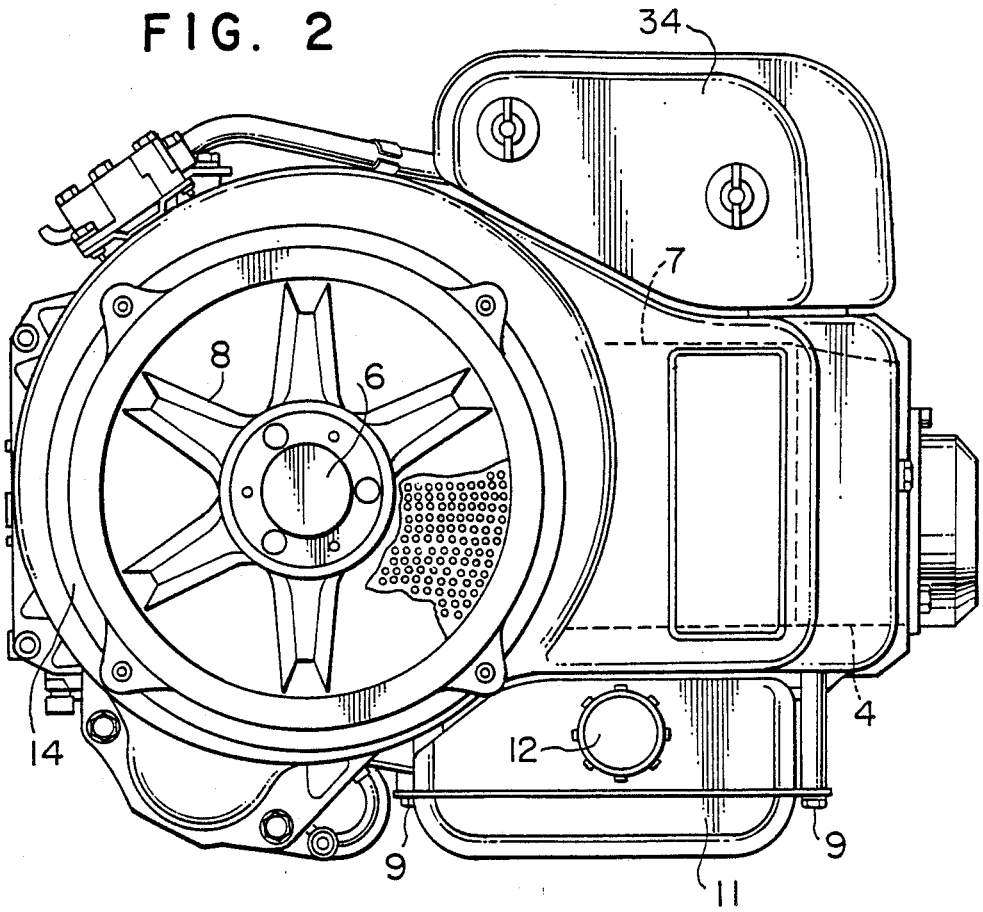
FIG. 2 is a plan view of the engine of vertical crankshaft type of FIG. 1 as seen in a direction shown by an arrow II in FIG. 1.

As shown in FIG. 2, an air cleaner 34 is arranged above a carburetor at one side of the cylinder portion 7, and the oil tank 11 is situated at the other side of the cylinder portion 7. Accordingly, the oil tank 11 and the air cleaner 34 are arranged one on each side of the cylinder portion 7, thus making the engine compact.

Figure 4:
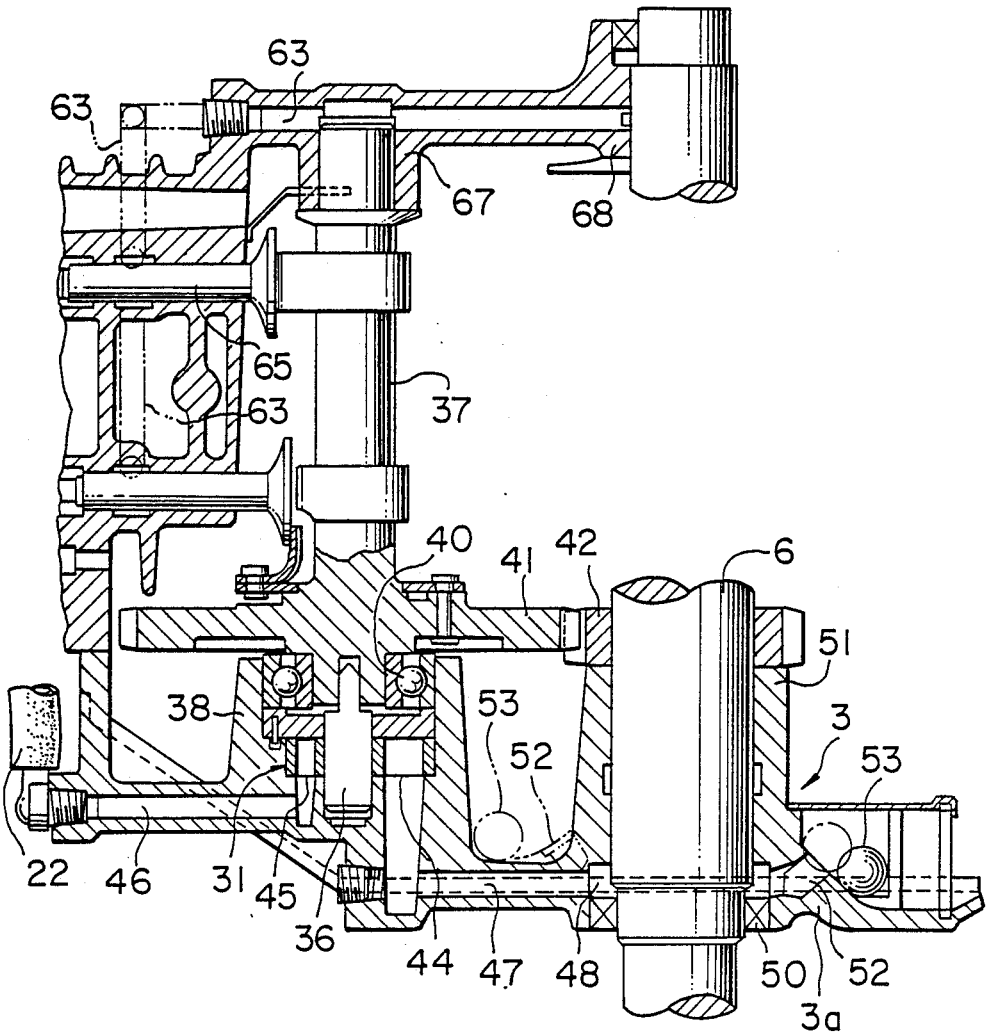
FIG. 4 is an enlarged sectional view taken along the line IV—IV of FIG. 1 and showing main portion of the engine.

As shown in FIG. 4, a cam shaft 37 arranged in parallel with the crankshaft 6 is operatively connected to the crankshaft 6 through a cam shaft gear 41 and a crankshaft gear 42 and is supported, at its lower end, by a bearing case portion 38 through a bearing 40. The bearing case portion 38 is formed integrally with the oil pan 3 and includes the low pressure oil feeding pump 31 therein.

The oil feeding pump 31 comprises a trochoid pump and has a pump shaft 36 arranged coaxially with the cam shaft 37 and connected to the lower end of the cam shaft 37 through an appropriate coupling mechanism.

A discharge opening 45 of the oil feeding pump 31 is connected to the intake rubber hose 22 through an oil passage 46 formed in the bottom portion 3*a* of the oil pan 3. An intake opening 44 of the oil feeding pump 31 is communicated with an annular oil groove 48 through an oil passage 47 formed in the bottom portion 3a of the oil pan 3. The annular oil groove 48 is formed in a lower end of a crankshaft bearing portion 51 to surround an outer periphery of the crankshaft 6 and is sealed at its lower side by an annular seal 50. By reserving the oil in the oil groove 48 temporarily, the bearing portion 51 at the lower portion of the crankshaft 6 and the seal 50 can easily be lubricated. The bearing portion 51 is formed integrally with the oil pan 3.

Two or more oil intake ports 52 formed in the oil groove 48 are open to the oil pan 3, and an upper end of each intake ports 52 is inclined outwardly from a centerline of the crankshaft (i.e., a point on the upper end nearest the centerline of the crank shaft is in the higher level than a point on the upper end remote from the centerline). A ball valve 53 associated with the corresponding intake port 52 is provided in such a manner that, when the upper end of the intake port 52 becomes higher (i.e., approaches a flat level) due to the inclination of the engine, the corresponding ball valve 53 shifts toward the centerline of the crankshaft to close the intake port. For example, when the engine is in a horizontal level, all of the intake ports 53 are open to the oil pan 3; however, if the engine is inclined rightwardly (FIG. 4) to become the left intake port higher, the left ball valve 53 shifts to the right, thereby closing the left intake port, while maintaining the right intake port 52 in an open condition. In this way, even when the engine is inclined in either directions, the introduction of air can be prevented effectively.

Figure 5:
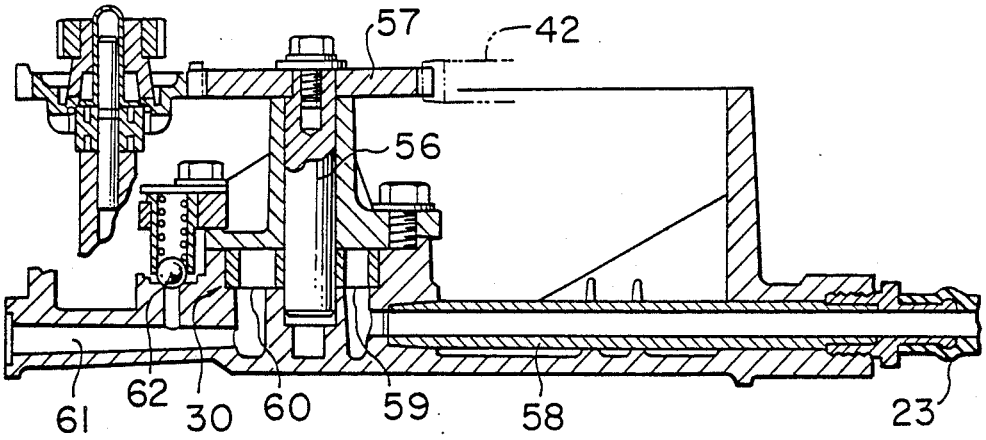
FIG. 5 is an enlarged sectional view taken along the line IV—IV of FIG. 1 and showing a main portion of the engine.

As shown in FIG. 5, a pump shaft 56 of the high pressure oil pump 30 is arranged vertically and is provided at its upper end with a pump drive gear 57 which meshes with the crankshaft gear 42. An intake port 59 is connected to the rubber hose 23 through an oil pipe 58 situated in the oil pan 3. A discharge port 60 is communicated with an oil passage 61 which includes a relief valve 62 on the way. The oil passage 61 is communicated with a lubricating oil passage 63 (FIG. 4) formed in the crank case, which lubricating oil paggage 63 is communicated with portions to be lubricated such as a sliding portion of a valve shaft 65, a bearing portion 67 of the cam shaft 37, a bearing portion 68 of the crankshaft 6 and the like.

Next, an operation of the lubricating apparatus according to the illustrated embodiment will be explained. Before the engine is started, a predetermined amount of oil is stored in the oil tank 11 (FIG. 1) and the oil pan 3, respectively.

When the engine is operated, the lubricating oil in the oil pan 3 (FIG. 4) is supplied or sucked to the low pressure oil feeding pump 31 through the intake ports 52, annular oil groove 48, oil passage 47 and pump intake opening 44. In the meantime, the oil in the annular oil groove 48 lubricates the crankshaft 6 and the seal 60.

The oil pressurized by the low pressure oil feeding pump 31 is introduced into the oil feeding pipe 19 through the oil passage 46, hose 22 and oil intake portion 15 (FIG. 1), and then is discharged from the upper oil discharging opening 19*a* into the oil tank 11.

The oil in the oil tank 11 is supplied or sucked to the oil pump 30 through the lower oil outlet portion 16, hose 23 and pipe 25, and then, after pressurized, is supplied to each of the lubricating portions of the crank case 1. The oil after lubrication is returned to the oil pan 3.

As mentioned above, according to the illustrated embodiment, since the vertical crankshaft and the oil pan arranged in the lower end of the crank case are provided, and the lubricating oil tank is provided independently from the oil pan, and since the oil is supplied to each of the lubricating portions by means of the oil pump after the oil is reserved temporarily in the oil tank by means of the oil feeding mechanism, by filling the predetermined amount of oil in the oil tank, it is possible to easily control the oil level, and the height of the engine can be reduced by using a shallow oil pan.

Further, in the engine of vertical crankshaft type according to the present invention, since the oil tank is provided independently from the oil pan having larger area and the oil is reserved in the oil tank, an adequate amount of oil can always be supplied to a desired portions even if the engine is inclined, and, accordingly, the engine which is not influenced upon the inclination thereof can be obtained.

In addition, since the oil tank is provided independently from the oil pan, a heat radiating area for the oil can be larger, thus preventing the increase in temperature of the oil, thereby stabilizing the amount of consumption of oil.

Figure 6:
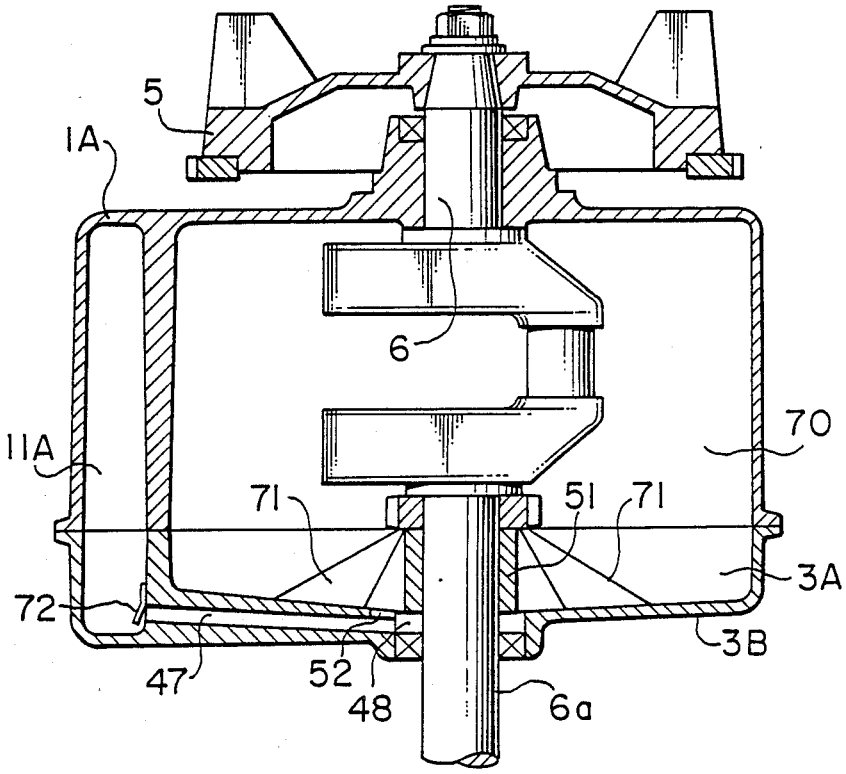
FIG. 6 is a cross-sectional view of a lubricating apparatus according to a second embodiment of the present invention.

FIG. 6 shows an alternation of the oil tank, oil pan and the like, where a lubricating oil tank 11A is formed integrally with a side wall of a crank chamber 70 of the engine of vertical crankshaft type. The side wall of the crank chamber comprises a side wall of a crank case 1A and a side wall of an oil pan 3A. A lower end of the oil tank 11A is communicated with the oil pan 3A through a check valve 72, oil passage 47, annular groove 48 and intake ports 52.

A bottom 3B of the oil pan 3A is so inclinded that it becomes lower as it approaches the centerline of the crankshaft 6, whereby the oil in the oil pan is gathered around the crankshaft bearing portion 51 to temporarily reserve the oil in the annular oil groove 48. The bearing portion 51 has a plurality of radial ribs 71 between which the corresponding intake port 52 is formed.

Further, in the arrangement shown in FIG. 6, as oil feeding means for feeding the oil from the oil pan 3A to the oil tank 11A, the check valve 72 and pressure fluctuation in the crank chamber 70 are utilized; accordingly, it should be noted that any special oil feeding pump is not used.

Figure 7:
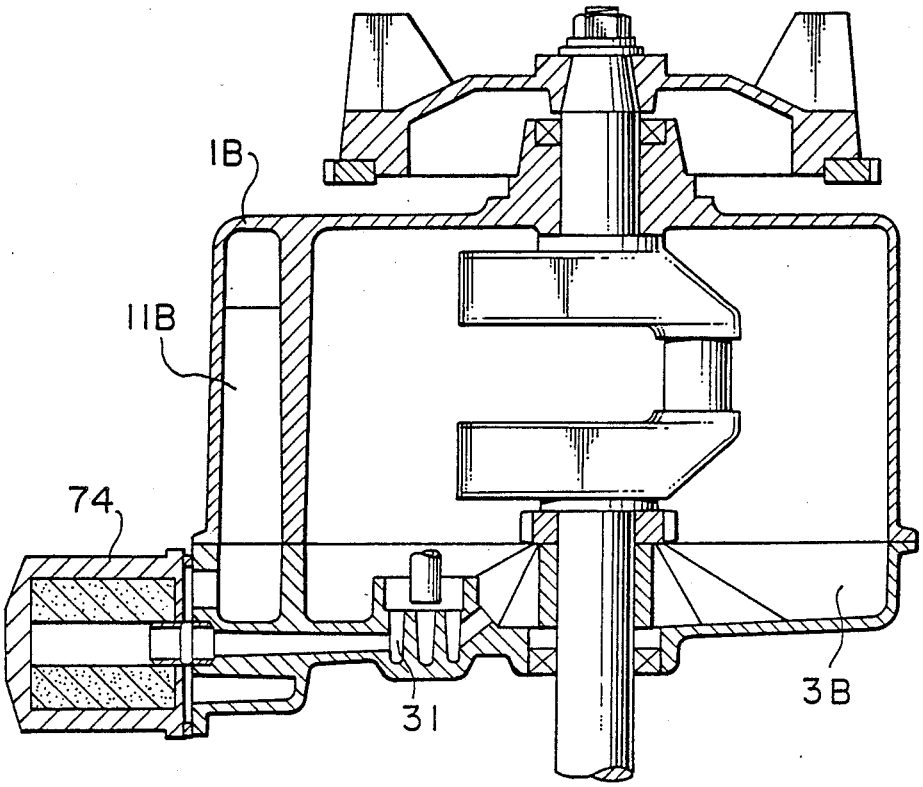
FIG. 7 is a cross-sectional view of a lubricating apparatus according to a third embodiment of the present invention.

In another embodiment shown in FIG. 7, an oil tank 11B is formed on the side wall of the crank chamber, integrally with a crank case 1B, and the oil tank 11B is provided with an oil filter 74. With this arrangement, the volume of the oil tank 11B can be increased by the use of the oil filter 74. The reference numeral 3B designate an oil pan.

Figure 8:
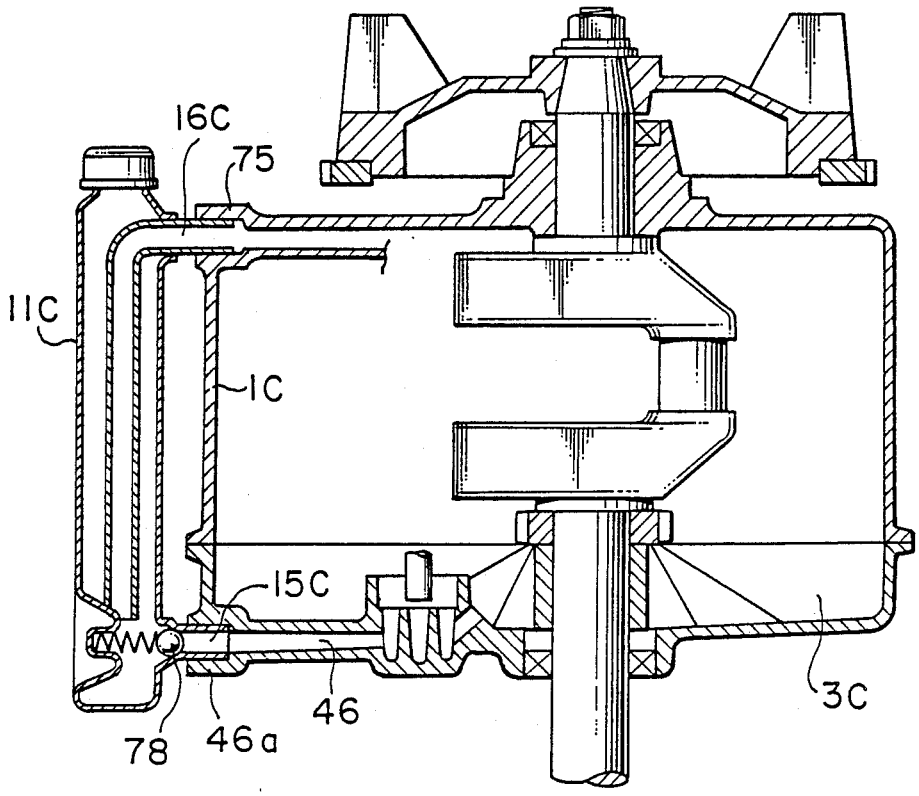
FIG. 8 is a cross-sectional view of a lubricating apparatus according to a fourth embodiment of the present invention.
Figure 9:
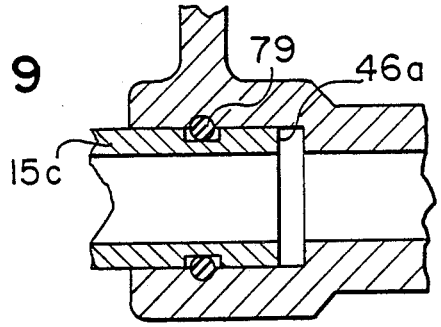
FIG. 9 is an enlarged sectional view showing a main portion of FIG. 8.

In a further embodiment shown in FIG. 8, an oil tank 11C is formed independently from a crank case 1C and is removably mounted (as a cartridge) on the side wall of the crank chamber. An oil intake portion 15C situated at a lower end of the oil tank 11C and an oil outlet portion 16C situated at an upper end of the oil tank are connected to a connecting port **46*a* of an oil passage 46 formed in an oil pan 3C and to a connecting port 75 formed in an upper end of the crank case 1C, respectively. A check valve 78 provided in the intake portion 15C prevents the back-flow of oil from the oil tank 11C to the oil passage 46. As seen in FIG. 9 showing an enlarged view of the intake portion 15C, an O-ring is arranged between an outer periphery of the intake portion 15C and an inner periphery of the connecting port 46*a*. Similarly, the oil outlet portion 16C shown in FIG. 8 is connected to the connecting port 75** through an O-ring (not shown).

In this way, when the oil tank 11C is constructed as the cartridge, an oil changing operation will be facilitated.

Figure 10:
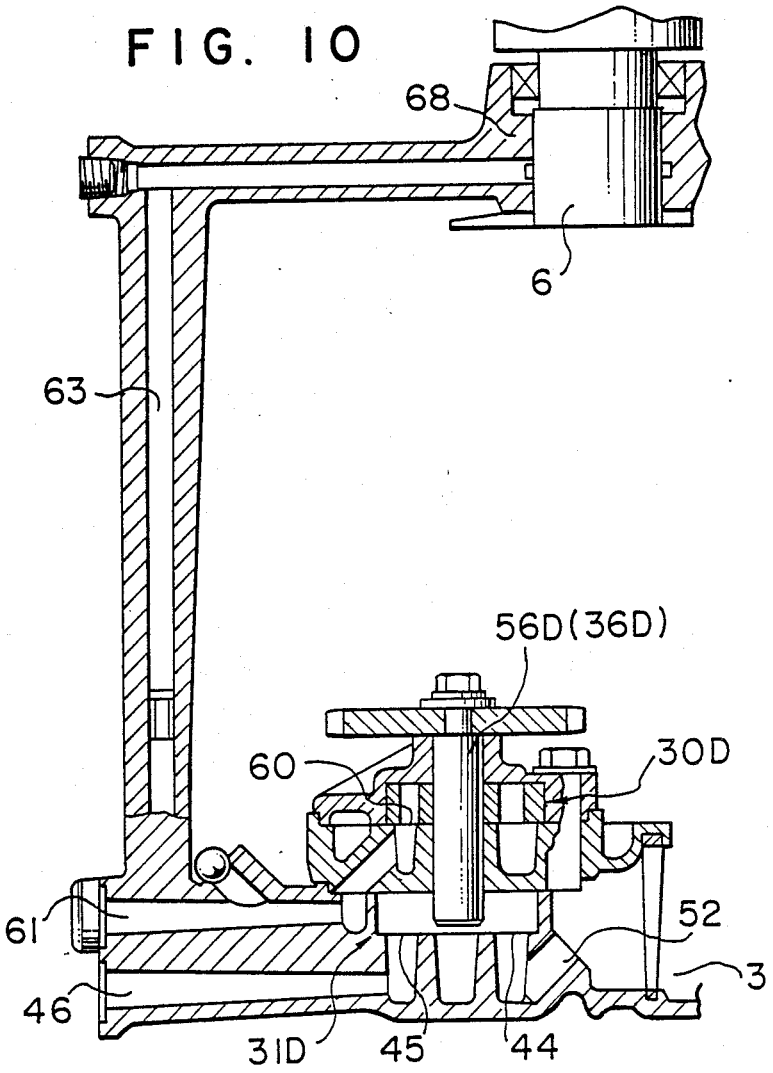
FIG. 10 is a cross-sectional view showing an alteration of an oil pump.

According to an oil pump assembly shown in FIG. 10, in order to make the pump assembly compact, a high pressure oil pump 30D and a low pressure oil feeding pump 30D are arranged coaxially with each other and have a common pump shaft 56D (36D). A discharge opening 60 of the oil pump 30D is communicated with a bearing portion 56 situated at the upper end of the crankshaft 6 through an oil passage 61 formed in the oil pan 3 and a lubricating oil passage 63 formed in the crank case 1, which bearing portion 68 is in turn communicated with each of the lubricating portions positioned below the bearing portion.

Figure 11:
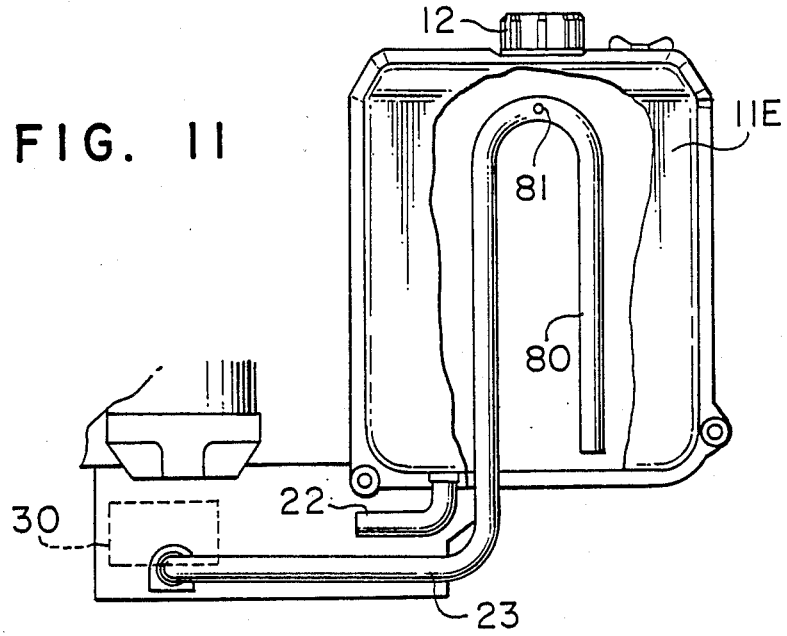
FIG. 11 is a side view, partially broken, of an oil tank of the vertical crankshaft type engine having a drain back-flow preventing siphon pipe.

In an oil tank shown in FIG. 11, as drain back-flow preventing means, an inverted U-shaped drain back-flow preventing siphon pipe 80 is arranged in the oil tank 11E. One of lower ends of the siphon pipe 80 is connected to the exhaust rubber hose 23, whereas the other lower end is open to the oil tank 11E near the bottom thereof. A small hole 81 is formed in the upper end of the siphon pipe 80.

Figure 12:
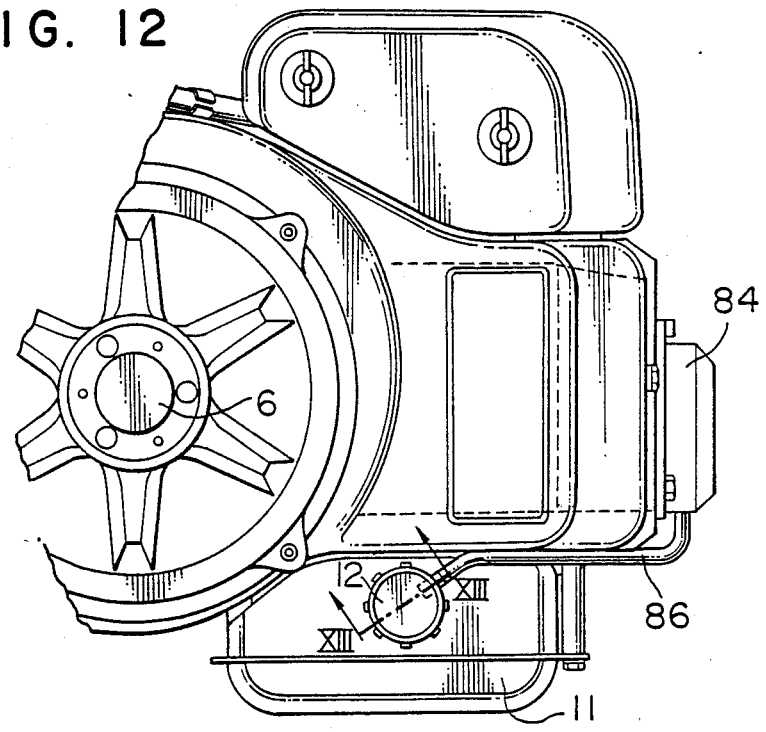
FIG. 12 is a plan view showing a main portion of the vertical crankshaft type engine having an oil leak preventing breather pipe.
Figure 13:
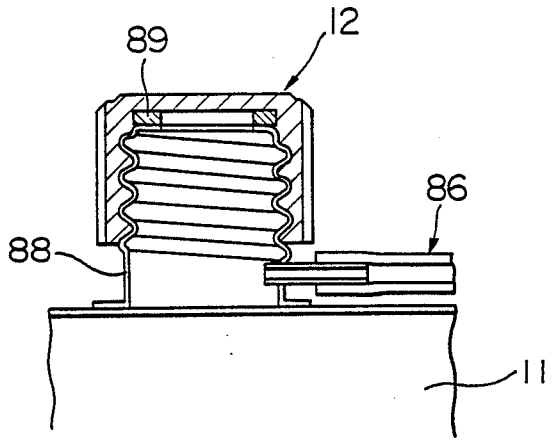
FIG. 13 is an enlarged sectional view taken along the line XIII—XIII of FIG. 12.

In an engine shown in FIGS. 12 and 13, a rocker chamber 85 or the interior of the crank case is communicated with a pouring port 88 provided on the top of the oil tank 11 through a pipe 86, whereby the pressure in the oil tank 11 is vented to the atmosphere through the rocker chamber 84 and the crank case, thus providing a breather for maintaining the pressure constant, and preventing leakage of oil from the breather. In FIG. 13, a numeral 89 denotes a gasket.

As mentioned above, while the present invention was explained in connection with the illustrated embodiments, by separating the oil tank from the crank case and arranging the oil tank at a position remote from the engine and by removably connecting the oil tank to the engine, the engine itself may be compacted, a freedom of the engine mount may be increased, the heat transfer from the engine to the oil tank may be reduced, and the oil tank may be arranged in any position where an operator can easily check or see the oil tank.

Further, if the oil tank is made of transparent or semi-transparent resin, it is possible to omit the oil level indicator and to easily check the filthiness of the oil.

As mentioned above, according to the present invention, by filling the predetermined amount of oil in the oil tank, it is possible to easily control the oil level, and by manufacturing the oil pan in the shallow configuration, it is possible to reduce the height of the engine.

Further, since the oil tank is provided independently from the oil pan having the large area and the oil is temporarily reserved in the oil tank, the adequate amount of oil can always be supplied to desired portions regardless of the inclination of the engine, thus obtaining the engine which is not influenced upon the inclination thereof.

In addition, since the oil tank is provided independently from the oil pan, a heat radiating area for the oil can be larger, thus preventing the increase in temperature of the oil, thereby stabilizing the amount of consumption of oil.

What is claimed is:

1. A lubricating apparatus for an engine of vertical crankshaft type having a vertical crankshaft and a crank case for supporting said crankshaft, comprising:

an oil pan arranged at a lower portion of said crank case;

an oil tank provided independently from said oil pan and having an intake portion communicated with said oil pan and an outlet portion communicated with each of lubricating portions;

oil pumps arranged between said oil tank and said each of the lubricating portions to supply the oil to said lubricating portions; and oil feeding means arranged between said oil tank and said oil pan to feed the oil from said oil pan to said oil tank.

2. A lubricating apparatus for an engine of vertical crankshaft type according to claim 1, wherein said engine of vertical crankshaft type has a cylinder portion, an air cleaner is arranged on one side of said cylinder portion, whereas said oil tank is arranged on the other side of said cylinder portion.

3. A lubricating apparatus for an engine of vertical crankshaft type according to claim 1, wherein said oil feeding means arranged between said oil tank and said oil pan include a low pressure oil feeding mechanism, a plurality of oil intake ports are formed in a bottom of said oil pan, and valve means are provided in such a manner that when the engine is inclined the higher intake port or ports are closed by said valve means.

4. A lubricating apparatus for an engine of vertical crankshaft type according to claim 1, wherein flow preventing means are provided for preventing flow of oil from said oil tank to said oil pan when the engine is stopped.

5. A lubricating apparatus for an engine of vertical crankshaft type according to claim 4, wherein said drain back-flow preventing means comprises a valve which closes when the engine is stopped.

6. A lubricating apparatus for an engine of vertical crankshaft type according to claim 4, wherein said drain back-flow preventing means comprises a siphon pipe arranged in said oil tank and provided at its upper end with a small hole.

7. A lubricating apparatus for an engine of vertical crankshaft type according to claim 1, wherein said oil pan has a bearing portion for supporting said crankshaft and is formed in such a manner that said bearing portion of said oil pan is lower than the remaining portion of said oil pan at a bottom of said oil pan, an oil groove is formed in said bearing portion to enclose said crankshaft, and said oil pan is communicated with said oil tank through said oil groove.

8. A lubricating apparatus for an engine of vertical crankshaft type according to claim 1, wherein said engine is an air cooled engine, and said oil tank acts also as a portion of a guide plate for cooling air for cooling said engine.

9. A lubricating apparatus for an engine of vertical crankshaft type according to claim 1, wherein said oil tank is formed on a side of said crank case.

10. A lubricating apparatus for an engine of vertical crankshaft type according to claim 9, including an oil filter attached to said oil tank.

11. A lubricating apparatus for an engine of vertical crankshaft type according to claim 1, wherein said oil tank is formed independently from said crank case and is removably attached to a side of said crank case.

12. A lubricating apparatus for an engine of vertical crankshaft type according to claim 1, wherein an upper end of said oil tank and an interior of said crank case are communicated with each other to provide breather means which do not cause oil leakage.

* * * * *